US006139004A

United States Patent [19]

Couillard et al.

[11] Patent Number: 6,139,004

[45] Date of Patent: Oct. 31, 2000

[54] ASSEMBLY AND METHOD FOR ROTATING AND PLACING STRIP OF MATERIAL ON A SUBSTRATE

[75] Inventors: Jack L. Couillard, Menasha; Joseph D. Coenen, Neenah, both of Wis.

[73] Assignee: Kimberly-Clark Worldwide, Inc., Neenah, Wis.

[21] Appl. No.: 09/346,241

[22] Filed: Jul. 1, 1999

[51] Int. Cl.[7] ..... B65H 29/38

[52] U.S. Cl. ..... 271/70; 271/188; 271/196; 271/83

[58] Field of Search ..... 271/276, 69, 70, 271/306, 188, 196, 197, 83

[56] References Cited

U.S. PATENT DOCUMENTS

| | | | |
|---|---|---|---|
| 4,286,907 | 9/1981 | Houle et al. | 271/83 X |
| 4,620,826 | 11/1986 | Rubio et al. | 271/197 X |
| 4,668,148 | 5/1987 | Sample et al. | 271/70 X |
| 4,954,033 | 9/1990 | Sanders | 271/70 X |
| 5,104,116 | 4/1992 | Pohjola | 271/185 |
| 5,224,405 | 7/1993 | Pohjola | 83/24 |

*Primary Examiner*—David H. Bollinger
*Attorney, Agent, or Firm*—Pauley Petersen Kinne & Fejer

[57] ABSTRACT

An assembly and method for rotating and placing a strip of material on a substrate making use of a conveyor which includes a contour-changing conveyance surface on which a strip of material is conveyed and a rotatable transfer element. The rotatable transfer element has a contoured strip securing surface. At a point of interaction of the transfer element and the conveyor, the conveyance surface assumes a contour corresponding to that of the strip securing surface. The transfer element then secures the material strip from the conveyor, then rotates the strip of material to a selected degree of angular rotation and then deposits the rotated strip of material in surface contact with an adjacent moving surface.

27 Claims, 4 Drawing Sheets

ASSEMBLY AND METHOD FOR ROTATING AND PLACING STRIP OF MATERIAL ON A SUBSTRATE

FIELD OF THE INVENTION

This invention relates generally to receiving and rotating strips of material and, more specifically, the invention relates to receiving and rotating strips of material and then placing the rotated strips in surface contact with a continuously moving surface.

BACKGROUND OF THE INVENTION

Various apparatus are available that receive strips of cut material and then manipulate the material strips such as by either or both rotating or pivoting the strips relative to their initial direction of movement and then placing such material strips on or near a continuously moving surface. In placing the strips of material relative to the moving surface, such apparatus generally begin the placement by initially contacting the leading edge of the strip with the moving surface and then progressively laying or rolling the strip upon the surface with the trailing edge of the strip being the last to be laid upon the moving surface.

A problem that exits with these apparatus is that rotation of the transferring element, upon which the strip is carried, can cause the transferring element to bite or dig into the moving surface, thereby undesirably cutting or otherwise damaging the moving surface. For example, as the transferring element releases the leading edge of the material strip and then begins to pivot or rotate upwardly away from the moving surface, the trailing edge of the transferring element pivots or rotates against and into the moving surface. This can either or both damage the moving surface and disrupt the proper positioning or registration of the strip with the moving surface, and is particularly undesirable when the moving surface is a woven or nonwoven material.

This problem is particularly acute when the strip being laid upon the moving surface is of a generally elongate or rectangular shape having its longest axis parallel to the direction of movement of the moving surface.

Another frequently occurring problem in such processing relates to the proper releasing of the strip of material from the transferring element to the moving surface. Generally, such strips of material are held on their respective transferring elements via a vacuum effect created or transmitted through perforations or holes in the outer surface of the transferring element. Unfortunately, these apparatus may not extinguish or otherwise release the vacuum against the strip of material as the strip of material is progressively transferred leading edge to trailing edge on the moving surface. For example, if the vacuum is not progressively extinguished as the strip is progressively laid from the transferring element onto the surface, portions of the strip element can continue to be held by vacuum against the transferring element resulting in an undesirable pleat or fold in the strip material, skewed alignment of the strip material with the moving surface, and the like.

In view of these and other perceived shortcomings in prior existing apparatus and processing relating to the receiving and rotating strips of material and then placing the rotated strips relative to a continuously moving surface, a new applicator apparatus and application process has been developed and is the subject of Pohjola, U.S. Pat. No. 5,104,116, issued Apr. 14, 1992, and Pohjola, U.S. Pat. No. 5,224,405, issued Jul. 6, 1993, the disclosures of each of which is incorporated herein by reference in its entirety. In accordance therewith, a strip of material is received and rotated toward a continuously moving surface, and then orientated so that the surface thereof is placed generally flat with the continuously moving surface via one or more puck rotating means. In accordance with certain preferred embodiments thereof, the apparatus additionally includes a surface-leveling means for positioning the puck surface in an appropriate spaced-apart relationship with the moving surface. To that end, these patents disclose puck assemblies which in addition to rotating, pivot such that the puck surface is placed flat against or with the moving surface, as desired, and such as may employ open cams.

While such apparatus and associated processing has been successful in overcoming, reducing or minimizing at least some of the problems or shortcomings of earlier apparatus and processing, there remains a need for further improvements. In particular, the employment of features such as pivoting plates and open cams have been found to be a major cause of such strip rotation applicator maintenance and delay. Thus, there is a need and a demand for further apparatus and processing improvements such as effective to achieve one or more of the following:

1. reduce or minimize required maintenance,
2. speed processing and
3. reduce or minimize such complications as may be associated with apparatus and processing relying on rotation and pivoting of puck members and the corresponding placement of an associated strip of material with a corresponding continuously moving surface.

SUMMARY OF THE INVENTION

A general object of the invention is to provide an improved assembly and method for rotating and placing a strip of material on a substrate.

A more specific objective of the invention is to overcome one or more of the problems described above.

The general object of the invention can be attained, at least in part, through an assembly which includes a conveyor and at least one strip transfer element. In accordance with one preferred embodiment of the invention, the conveyor includes at least one contour-changing conveyance surface on which a strip of material is conveyed. The at least one transfer element has a strip securing surface with a curved planar contour effective to interact with the conveyor to secure the strip of material from the at least contour-changing conveyance surface. The at least one transfer element then rotates the strip of material to a selected degree of angular rotation. Subsequently, the at least one transfer element deposits the rotated strip of material in surface contact with an adjacent moving surface. In such assembly, the at least one contour-changing conveyance surface assumes a contour corresponding to the curved planar contour of the strip securing surface.

The prior art generally fails to provide assemblies and methods for rotating and placing a strip of material on a substrate which permit desirably high speed processing for extended periods of time such as reducing or minimizing required maintenance and such complications as may be associated with apparatus and processing relying on rotation and pivoting of puck members and the corresponding placement of an associated strip of material with a corresponding continuously moving surface.

The invention further comprehends an improved assembly such as used to rotate and place a strip of material on a substrate, particularly, a continuously moving substrate. The assembly includes a conveyor having a conveyance surface on which a strip of material is conveyed and at least one rotating puck member. The puck member is effective, at a point of interaction with the conveyor, to receive a strip of material from the conveyor, then rotate the strip of material to a selected degree of angular rotation and then place the rotated strip of material in surface contact with a moving surface.

In accordance with one preferred embodiment of the invention, the at least one rotating puck member has a convex contoured strip securing surface, while the conveyance surface at the point of interaction assumes a concave contour corresponding to the convex contour of the strip securing surface of the at least one rotating puck member.

The invention still further comprehends a method for rotating a strip of material and placing the rotated strip of material in surface contact with a moving surface. In accordance with one embodiment of the invention, one such method involves providing at least one strip of material having a first axis in a first angular orientation on a first continuously moving contour-changing conveyance surface. The at least one strip of material is subsequently secured from the first continuously moving contour-changing conveyance surface onto a rotatable transfer element having a strip securing surface with a curved planar contour, the conveyance surface having assumed a contour corresponding to the curved planar contour of the strip securing surface. The at least one strip of material secured to the rotatable transfer element is then rotated a selected degree of angular rotation so that the first axis of the at least one strip of material is in a selected second angular orientation. The rotated at least one strip of material strip is then positioned in surface contact with a moving surface.

Other objects and advantages will be apparent to those skilled in the art from the following detailed description taken in conjunction with the appended claims and drawings.

DETAILED DESCRIPTION OF THE INVENTION

The present invention, as is described in more detail below, provides an improved assembly and method for rotating a strip of material and placing the rotated strip of material in surface contact with a moving surface.

Figure 1:
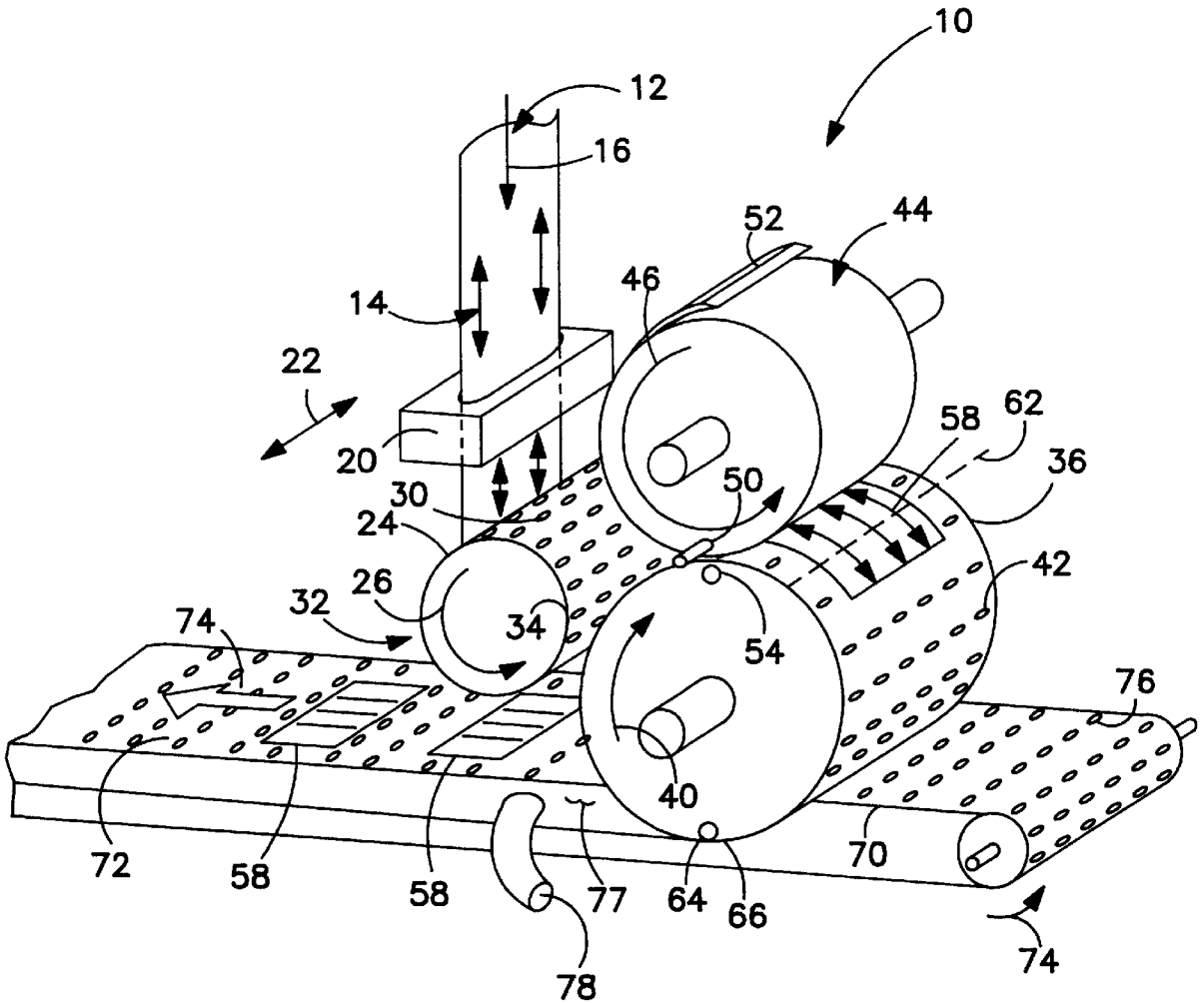
FIG. 1 is a simplified fragmentary perspective schematic of an assembly for forming strips of material from a continuous web for use in the practice of the invention.

Referring to FIG. 1, there is illustrated an assembly, generally designated by the reference numeral 10 and such as may be used in the formation of discrete strips of material such as may be used in the practice of the invention.

As shown, a continuous web 12 is introduced to the assembly 10 such as via a conveyor belt from any suitable web supply assembly (not shown), such as a controlled tension unwind, for example. The web 12 can be of any type of material such as a woven or nonwoven material, and can be supplied as a single web or ribbon of material, or a plurality of webs or ribbons of material. If there is a plurality of webs or ribbons of material, the materials of which the webs or ribbons are made can also be different. Example of nonwoven webs include, but are not limited to, paper and paper-like material, pressure-sensitive tape material, mechanical fastener material such as hook-and-loop material, films of thermoplastic material, spun bond or melt blown thermoplastic material, an elastomeric material, or a stretch bond laminate material. A stretch bond laminate material comprises a stretchable material that is stretched and then bonded to a gatherable material and then allowed to relax to form the laminate.

In accordance with one preferred embodiment of the invention, the continuous web 12 desirably is a stretchable spun bond laminate ("SBL"), with stretch in the direction of the arrows 14. In FIG. 1, the web 12 has an initial direction of conveyance or travel indicated by the arrows 16. In the illustrated embodiment, the direction of stretch and such direction of conveyance for the web coincide.

If desired, and as shown, the continuous web 12 may be introduced via a web steering device 20, as is generally known in the art, such as to assist in maintaining proper and desired positioning and placement of the web 12 in the cross machine direction, signified by the arrow 22. As will be appreciated, such a web steering device, if included, may be present either as a separate device or apparatus or as a part of the assembly 10, as may be desired.

The continuous web 12 is transferred to a rotatable vacuum feed roll 24 having a direction of rotation signified by the arrow 26. The vacuum feed roll 24 has a plurality of perforations 30 therein. A vacuum is created, generated or provided within the vacuum feed roll 24, such as is known in the art and such as may serve to hold the web 12 thereto. In the particularly illustrated embodiment, the vacuum feed roll 24 holds the web 12 with a controlled vacuum from about the 9 o'clock position 32 to a tangent point 34 of the vacuum feed roll 24 with an associated rotatable vacuum anvil roll 36.

At the tangent point 34, the web 12 is transferred to the rotatable vacuum anvil roll 36 which has a direction of rotation signified by the arrow 40. Similarly to the rotatable vacuum feed roll 24 described above, the rotatable vacuum anvil roll 36 has a plurality of perforations 42 therein. A vacuum created, generated or provided within the anvil roll 36, such as is known in the art, serves to hold the web 12 lightly to the anvil roll 36.

The web 12 on the anvil roll 36 is acted upon by a rotatable knife roll 44 which has a direction of rotation signified by the arrow 46. The knife roll 44 includes first and second cutting edges 50 and 52, respectively. More specifically, the first knife roll cutting edge 50 contacts a first cutting surface 54 on the anvil roll 36 or otherwise serves to cut the web into discrete strips of material 58, having a longitudinal axis 62. The second knife roll cutting edge 52 similarly contacts a second cutting surface 64 on the anvil roll 36 or otherwise serves to correspondingly cut a subsequent portion of the web into an additional discrete strip of material.

In the illustrated assembly 10, the knife roll 44 is a two-repeat roll which is geared (timed) to the anvil roll 36 to make a cut each half revolution. The anvil roll 36 is desirably sized such that it has a circumference in which is a multiple of the product repeat length and a suitable draw. In the illustrated assembly 10, the anvil roll 36 is a two-repeat roll.

The strip cutting assembly 10 described above is sometimes referred to as a slip cut assembly as, in such an assembly, the web 12 can desirably slip on the surface of the anvil roll until it is cut. In practice, the speed of rotation of the vacuum feed roll can be selected to provide the desired amount (length) for the strips of material.

Further, a vacuum feed roll having a roughened web-contacting surface can desirably be employed. As will be appreciated, a vacuum feed roll having a roughened web-contacting surface can result in increased friction between the web material and the web-contacting surface thereof such as can desirably reduce the amount of vacuum required in order to properly maintain the associated web material relative thereto. One technique for obtaining such a suitably roughened surface is via the application onto the feed roll of an appropriate plasma spray coating, such as known in the art. Other techniques for such surface roughening will be apparent to those skilled in the art and can, if desired, be used.

As will be appreciated, the broader practice of the invention is not necessarily limited by the size of the rolls or the number of cutting edges as for example, knife rolls with one or more cutting edges can be used. Further, suitable cutting devices other than knife rolls and such as known in the art can, if desired, be used.

In accordance with the invention, the size or dimensions of the material strips 58 can be selected to meet the requirements of a specific use thereof. For example, such strips of material of a longitudinal length of about 15 inches and a lateral width of about 3 inches are well suited for use in association with the manufacture and production of disposable pant-like garments for absorbing human discharge. It is to be understood, however, that the broader practice of the invention is not necessarily limited to material strips of such length and/or width or to the manufacture or production of such specific items of manufacture.

The anvil roll 36 holds first the web 12 and then, upon formation, the strips of material 58 with a controlled vacuum from the tangent point 34 to a tangent point 66 of the anvil roll 36 with a lower vacuum conveyor 70. In the illustrated preferred embodiment, the lower vacuum conveyor 70 has a conveyance speed which matches the speed of the anvil roll 36. The lower vacuum conveyor 70 includes a conveyance surface 72 on which the material strips 58 are conveyed in a direction signified by the arrows 74. In a manner similar to that described above, the conveyance surface 72 includes a plurality of perforations 76 therein such as to permit a vacuum created, generated or provided in or by the conveyor 70 to hold the material strips 58 thereto. More particularly and as shown in FIG. 1, such vacuum may be so provided by means of a vacuum chamber 77 underlying a selected portion of the conveyance surface 72 and an associated vacuum-supplying hose 78, such as is generally known in the art.

Figure 2:
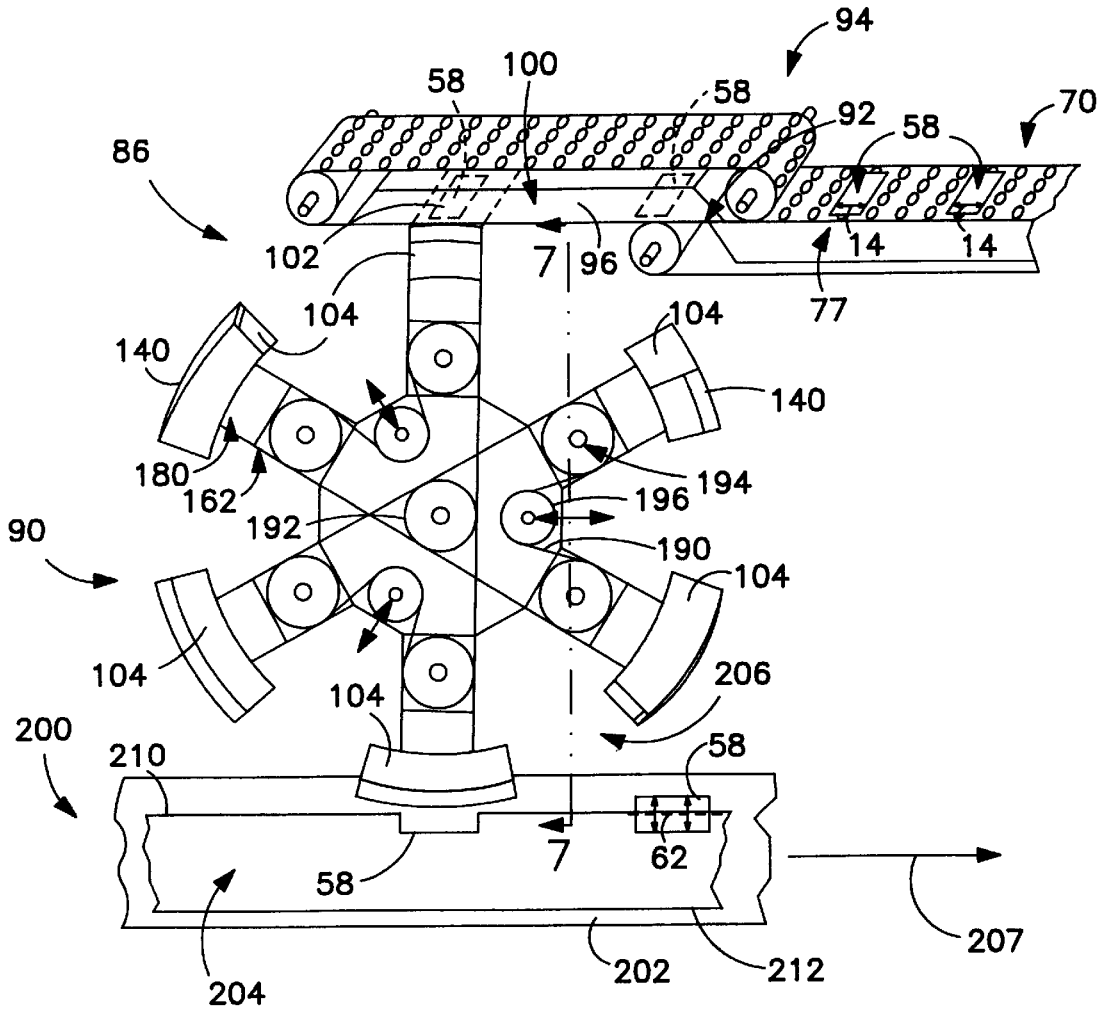
FIG. 2 is a simplified fragmentary perspective view of a processing system, in accordance with one preferred embodiment of the invention, whereby a strip of material is rotated and placed in surface contact with a moving surface.

Turning now to FIG. 2, a processing system, generally designated by the reference numeral 86, is shown. As described in greater detail below, the processing system includes a handling apparatus, generally designated by the reference numeral 90, for rotating a strip of material and placing the rotated strip of material in surface contact with a moving surface in accordance with one preferred embodiment of the invention.

More specifically, in the processing system 86, the lower vacuum conveyor 70 continues the conveyance of the strips of material 58 having a direction of stretch again signified by the arrows 14. As shown, the strips of material 58 desirably are evenly spaced on the conveyance surface 72. In particular, the vacuum of the conveyor 70 holds the strips of material 58 with a controlled vacuum, such as via the vacuum chamber 77, described above. More specifically, the vacuum of the lower conveyor 70 holds the strips of material 58 with a controlled vacuum to a tangent region 92 of the lower vacuum conveyor 70 with an upper vacuum conveyor 94.

At the tangent region 92, the strips of material 58 are individually and successively transferred onto the upper vacuum conveyor 94, specifically to a contour-changing conveyance surface 96 thereof. For example, at or near the tangent region 92, the vacuum of the lower vacuum conveyor 70 is extinguished or otherwise ceases to hold the material strips 58 thereto by vacuum means. Similarly, at or near the tangent region 92, a vacuum is created, generated or provided within the upper vacuum conveyor 94. For example and as shown, such vacuum may be so provided by means of a vacuum chamber or box 100 and an associated vacuum-supplying hose or duct (not shown), such as is generally known in the art. The application of such a vacuum desirably serves to hold the material strips 58 adjacent the contour-changing conveyance surface 96.

The upper vacuum conveyor 94 continues the conveyance of the material strips 58 with a controlled vacuum supplied via the vacuum chamber 100 to a tangent point 102 of the upper vacuum conveyor 94 with the handling apparatus 90 and, more specifically, a transfer element 104 thereof. Both the handling apparatus 90 and the transfer elements 104 are described in greater detail below.

Now referring to FIGS. 3–6, the upper vacuum conveyor 94 is shown in greater detail. As shown, the upper vacuum conveyor 94 includes first and second rotatable conveyor rollers, 110 and 112, respectively, and an associated closed loop conveying surface 114, in a manner generally similar to that known in the art. The conveying surface 114 desirably has the form of a screen or perforated belt with a plurality of perforations or openings 116. The closed loop conveying surface 114 includes a lower or conveyance path 120 and an upper or return path 122.

As described in greater detail below with reference to FIGS. 3–6, the upper vacuum conveyor 94 includes at least one contour-changing conveyance surface on which the strips of material are sequentially conveyed. In particular, the vacuum box 100 is positioned adjacent the closed loop conveying surface 114. The vacuum box 100 is generally formed by a three-sided structure 124, leaving a fourth side 126 open. The structure 124 includes a collar 130 at the fourth side 126 adjacent against which is placed a member 132 sometime referred to as a "skid plate."

The skid plate 132, such as made of steel or stainless steel, is produced, bent or otherwise formed to have a desired contour shape. Further, the skid plate 132 includes an array of perforations, holes or slots 134 such as to permit the vacuum provided or supplied via the vacuum chamber 100 to be transmitted therethrough to the contour-changing conveyance surface 96. As will be appreciated, such vacuum transmission desirably results in the contour-changing conveyance surface 96 being drawn adjacent the specifically contoured skid plate 132 and assuming a corresponding contour. In turn, the vacuum is communicated through the conveyance surface perforations 116 to hold the material strips 58 adjacent thereto to assume a corresponding contour.

Figure 3:
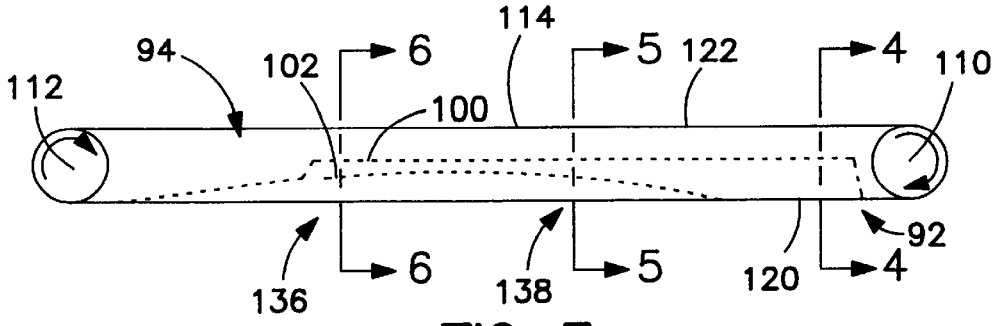
FIG. 3 is a simplified side view of the upper vacuum conveyor of the processing system shown in FIG. 2.
Figure 4:
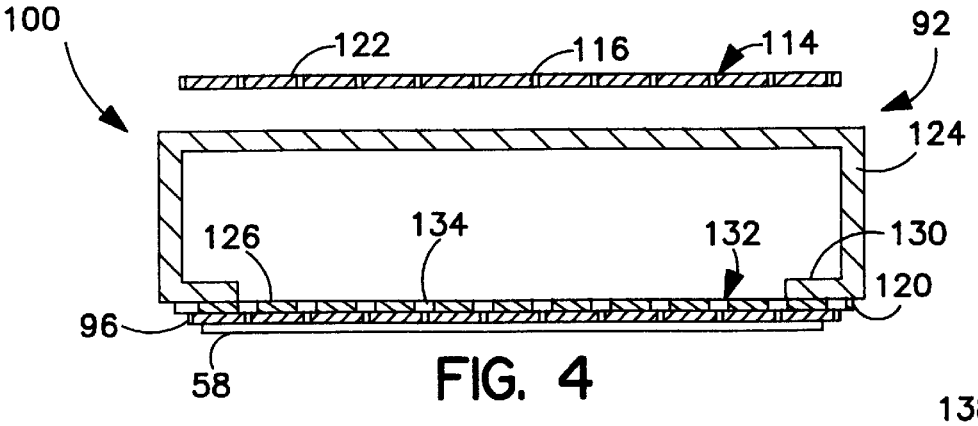
FIG. 4 is a simplified partially in section view taken substantially along the line 4—4 of FIG. 3 and viewed in the direction of the arrows.

Referring to FIGS. 3 and 4, the skid plate 132 in the tangent region 92 near or adjacent the first roller 110 has a generally flat cross sectional contour. In turn, the conveyance surface 96 adjacent thereto and the strips of material 58 conveyed thereat also have a generally flat cross sectional contours. As will be appreciated, such a flat contour may desirably serve to facilitate transfer of the material strips from the lower vacuum conveyor, as such a flat contour desirably may serve to increase or maximize the surface area of the conveyance surface in contact with the material strips in the tangent region.

Figure 6:
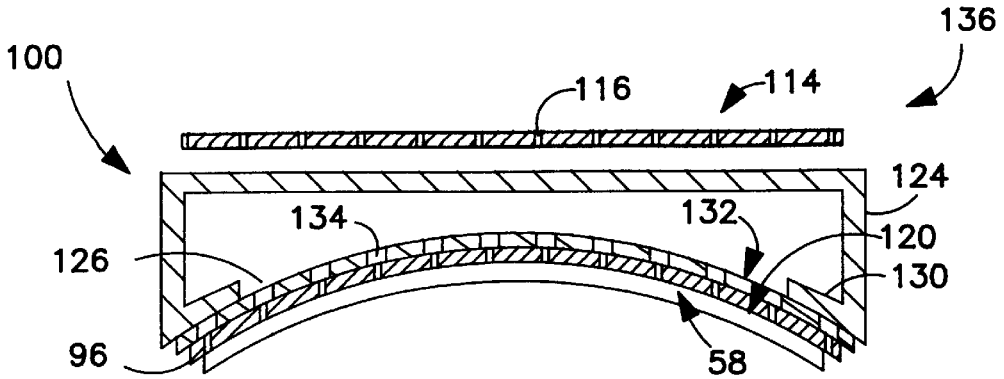
FIG. 6 is a simplified partially in section view taken substantially along the line 6—6 of FIG. 3 and viewed in the direction of the arrows.

Referring to FIGS. 3 and 6, the skid plate 132 in a region 136 near or at the tangent point 102 assumes a cross sectional contour of a curved planar form. In turn, the conveyance surface adjacent thereto and the strips of material conveyed thereat also assume similar curved planar contour forms. In particular, the curved planar contour desirably corresponds to the radius of the associated transfer element.

Figure 5:
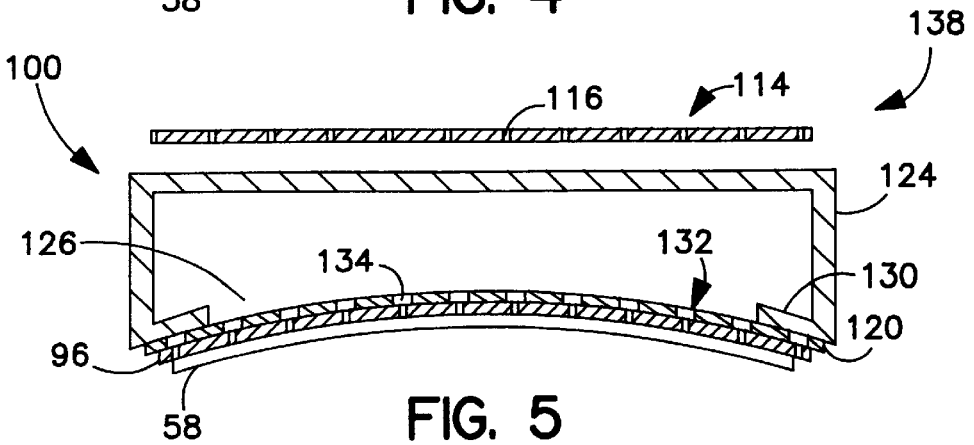
FIG. 5 is a simplified partially in section view taken substantially along the line 5—5 of FIG. 3 and viewed in the direction of the arrows.

Referring to FIGS. 3 and 5, the skid plate 132 in a intermediate region thereof, generally designated by the reference numeral 138, between the tangent region 92 and the region 136 has a transition contour intermediate between the generally flat cross sectional contour occurring in the tangent region 92 and the curved planar contour occurring at the region 136, described above. In turn, the conveyance surface and the strips of material at the intermediate region also assume similar transitional contours.

Thus, it is to be appreciated that in accordance with a preferred embodiment, the invention makes use of a contour-changing conveyance surface. While the change in contour of such conveyance surface can be variously effected without departing from the broader teachings provided herein, a preferred technique for changing the contour of such conveyance surface accomplishes such change in contour via the application of a specifically contoured member adjacent the conveyance surface and through which member a vacuum is transmitted or communicated.

As shown in FIG. 2, the handling apparatus 90 include a plurality of transfer elements 104. Each of the transfer elements 104 includes a strip securing surface 140. As perhaps best seen by reference to FIG. 7, such strip securing surface 140 advantageously may have a curved planar contour which, in accordance with a preferred practice of the invention, desirably may serve to facilitate handling of the material strips 58.

While the handling apparatus 90 illustrated in FIG. 2 includes six (6) such transfer elements 104, it will be appreciated that the broader practice of the invention is not limited by the number of transfer elements. The specific number of transfer elements utilized will generally be dependent on the particulars of the processing scheme in which the handling apparatus is to be applied.

Figure 7:
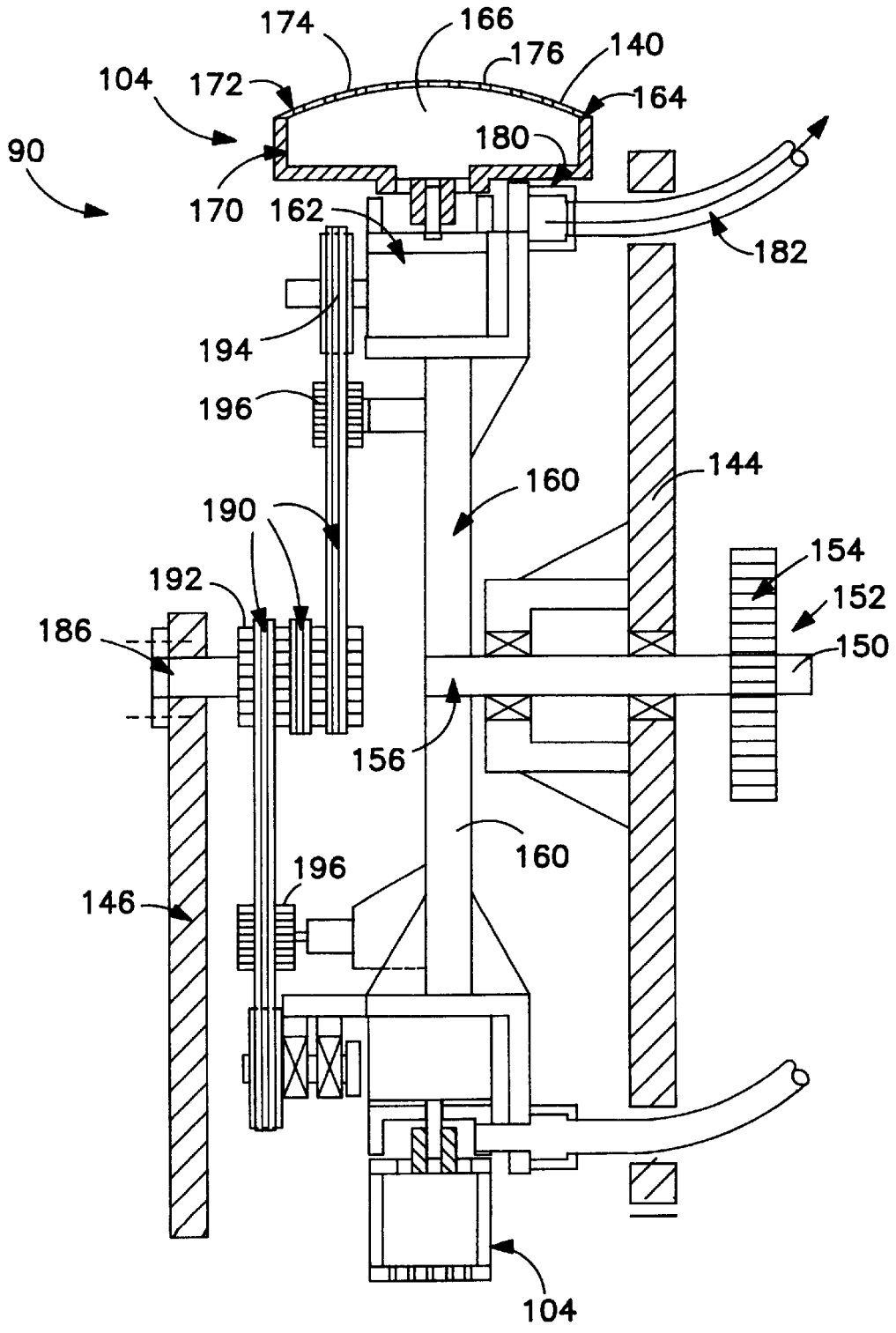
FIG. 7 is a simplified partially in section view taken substantially along the line 7—7 of FIG. 2 and viewed in the direction of the arrows.

Referring to FIGS. 2 and 7, the handling apparatus 90 includes a drive side frame 144 and an operator side frame 146. A drive shaft 150 is passed through the drive side frame 144. The drive side shaft 150 has a outer end portion 152 operatively joined or connected, such as in a manner known in the art, to a suitable drive supply assembly, such as of construction known in the art and such as may include a drive pulley 154 (but not otherwise shown). The drive shaft 150 also has an inner end portion 156 such as joined or operatively connected with each of the transfer elements 104.

More particularly, the transfer elements 104 each include a rotating member 160 joined or operatively connected with the drive shaft 150. The transfer elements 104 each also include an oscillating cam box 162 operatively joined or connected with a respective associated rotating member 160 and a vacuum puck assembly 164 in turn operatively joined or connected to an associated oscillating cam box 162, such as in a manner know in the art.

Referring to FIG. 7, the vacuum puck assemblies 164 may include a puck member 166 such as having a puck body 170 with a puck cover 172 forming a strip securing surface 174 having a plurality of perforations 176 passing therethrough. The puck body 170 is in communication with a vacuum shoe 180 and an associated vacuum providing duct or hose 182. The puck body 170 is of a form, e.g., hollow or otherwise, which permits communication of the vacuum to the strip securing surface 174. The strip securing surface 174 has a curved planar contour. In particular, in the illustrated embodiment, such curved planar contour is convex in shape or form.

The handling apparatus 90 also includes a stationary shaft 186 passed through and joined or connected with the operator side frame 146. The stationary shaft 186 is operatively joined or connected with the transfer elements 104, in a manner such as known in the art, to permit the desired rotation of the puck assemblies 164. In the illustrated embodiment, such joinder or connection of the stationary shaft 184 with the transfer elements 104 is effected by a timing belt 190 in association with a series of pulleys such as including a stationary pulley 192, a cam box drive pulley 194 for each of the transfer elements 104 and associated idler or take-up pulleys 196.

As will be appreciated, the transfer elements can be appropriately rotated to a selected degree of angular rotation. In practice, angular rotations of about 90 degrees has been are favorable for various commercial manufacturing applications. It is to be understood, however, that the broader practice of the invention is not necessarily so limited.

Returning to FIG. 2, the material strips 58 upon being rotated a selected angle of rotation from the original orientation (in the illustrated embodiment, an angular rotation of 90 degrees) are transferred or placed in surface contact with an adjacent moving surface, e.g., the rotated strips of material 58 are transferred onto a product assembly conveyor 200, specifically onto a belt 202 thereof and which belt conveys a continuous substrate 204.

As will be appreciated, such transfer can be effected by extinguishing or otherwise ceasing to hold the desirably rotated material strip 58 to the associated transfer element 104. In the illustrated embodiment, such transfer position generally designated by the reference numeral 206 generally corresponds to the 6 o'clock position. It will be understood, however, that other suitable transfer positions can be used and the broader practice of the invention is not necessarily limited by the transfer position utilized in a particular application.

The substrate 204 on the belt 202 has a general direction of conveyance or travel signified by the arrow 206. Further, the substrate 204 can be delivered thereto from any conventional type of supply assembly such as known in the art. In practice, the substrate 204 can be any type of woven or nonwoven material. The material strips applied, e.g., rolled onto, the substrate 204 can be held, fastened, joined or the like thereto by various techniques or means such as known in the art. For example, such material strips can be glued or bonded to the substrate.

In practice, a continuous substrate of a form commonly referred to as a "sausage" is used. Such a continuous substrate is generally composed of various layers of materials such as desired and included in the particular product being processed. For example, for a disposable pant-like garment for absorbing human discharge herein described, such a continuous substrate or sausage is generally an assembly composed of one or more layers of material. While such a garment can be variously constructed, in practice such a garment will typically include one or more liquid-pervious liners, absorbent inserts, and a liquid impervious outer cover such as composed of a cloth-like material. The continuous substrate 204 additionally may generally include flaps, waist band elastic, leg elastics, etc. or the like such as may serve to facilitate the placement and attachment of the final product onto an appropriate individual. In practice, the continuous substrate will have a repeat length which will be dependent on the grade or size of the specific garment product being manufactured. For example, a children's training pant garment will typically be formed using a continuous web having a repeat length of about 16 to about 32 inches with the specific repeat length again being dependent on the grade or size of the training paint garment being formed.

It will be understood, however, that the broader practice of the invention is not limited by the specific construction, shape, form or size of the substrate or the product being processed. For example, if desired, the invention can be practiced in conjunction with a substrate composed of a single material. Further, although the web 12 and the substrate 204 have been described as continuous materials, the present invention also contemplates that the substrate 204 can be a series of discrete material sheets and that the web 12 can be supplied to the assembly of the invention as discrete strips or ribbons of material.

The present invention is utilized in this embodiment to rotate the strips of material 90 degrees relative to the initial direction of movement, as indicated by the arrow 74 (shown in FIG. 1), and subsequently deposit the rotated material strip on an adjacent moving surface. In particular, the rotated strips of material are deposited along a first longitudinal side 210 of the substrate 204 such that the longitudinal axis 62 of the strips of material are generally parallel to the substrate direction of movement 206.

While the invention has been described above relative to the depositing and securing of strips of material along a first side 210 of a product sausage, it will be appreciated that the invention can correspondingly be practiced to alternatively or in addition deposit and secure strips of material along a second, opposed side 212 thereof.

The present invention may also be adapted to place a plurality of strips of material with a multiple number of substrates in a manner similar to that just described.

In view of the above, it will be appreciated that the present invention provides assemblies and methods for rotating a strip of material and placing the rotated strip of material in surface contact with a moving surface which generally permit higher speed processing such as by reducing or minimizing required maintenance and such complications as may be associated with apparatus and processing relying on rotation and pivoting of puck members and the corresponding placement of an associated strip of material with a corresponding continuously moving surface.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An assembly comprising:

a conveyor including at least one contour-changing conveyance surface on which a strip of material is conveyed and at least one transfer element having a strip securing surface with a curved planar contour effective at a point of interaction with the conveyor to secure the strip of material from the at least one contour-changing conveyance surface, then rotate the strip of material to a selected degree of angular rotation and then deposit the rotated strip of material in surface contact with an adjacent moving surface, wherein at the point of interaction of the at least one transfer element with the conveyor the at least one contour-changing conveyance surface assumes a contour corresponding to the curved planar contour of the strip securing surface.

2. The assembly of claim 1 wherein the conveyor also includes a contour-shaped member adjacent the at least one contour-changing conveyance surface.

3. The assembly of claim 2 wherein the conveyor also includes a vacuum box adjacent the contour-shaped member.

4. The assembly of claim 3 additionally comprising a vacuum creating system effective to transmit a vacuum to the at least one contour-changing conveyance surface whereby the at least one contour-changing conveyance surface assumes a contour corresponding to the adjacent member.

5. The assembly of claim 1 wherein the strip securing surface of the at least one transfer element is convex in contour and the at least one contour-changing conveyance surface at the point of interaction assumes a corresponding concave contour.

6. The assembly of claim 1 wherein the selected degree of angular rotation is about 90 degrees.

7. The assembly of claim 1 wherein the at least one transfer element comprises a rotating puck member.

8. The assembly of claim 7 wherein the selected degree of angular rotation is about 90 degrees.

9. The assembly of claim 1 comprising a plurality of transfer elements.

10. The assembly of claim 9 wherein each of the plurality of transfer elements sequentially interact with the conveyor.

11. The assembly of claim 10 wherein each of the plurality of transfer elements sequentially rotate successive strips of material about 90 degrees.

12. The assembly of claim 11 wherein at least one of the plurality of transfer elements comprises a rotating puck member.

13. The assembly of claim 12 wherein more than one of the plurality of transfer elements comprises a rotating puck member.

14. The assembly of claim 13 wherein each of the plurality of transfer elements comprises a rotating puck member.

15. In an assembly comprising a conveyor having a conveyance surface on which a strip of material is conveyed and at least one rotating puck member effective at a point of interaction with the conveyor to receive the strip of material therefrom and then rotate the strip of material to a selected degree of angular rotation and then place the rotated strip of material in surface contact with a moving surface, the improvement comprising:

the at least one rotating puck member having a convex contoured strip securing surface and the conveyance surface at the point of interaction with the at least one rotating puck member assuming a concave contour corresponding to the convex contour of the strip securing surface of the at least one rotating puck member.

16. The assembly of claim 15 wherein the selected degree of angular rotation is about 90 degrees.

17. The assembly of claim 15 comprising a plurality of the rotating puck members.

18. The assembly of claim 17 wherein each of the plurality of the rotating puck members sequentially interact with the conveyance device.

19. A method for rotating a strip of material and placing the rotated strip of material in surface contact with a moving surface comprising:

providing at least one strip of material having a first axis in a first angular orientation on a first continuously moving contour-changing conveyance surface, securing the at least one strip of material from the first continuously moving contour-changing conveyance surface onto a rotatable transfer element having a strip securing surface with a curved planar contour, at a conveyance point whereat the conveyance surface has a contour corresponding to the curved planar contour of the strip securing surface, rotating the at least one strip of material secured to the rotatable transfer element a selected degree of angular rotation so that the first axis of the at least one strip of material is in a selected second angular orientation and positioning the rotated at least one strip of material strip in surface contact with a moving surface.

20. The method of claim 19 wherein the selected degree of angular rotation is about 90 degrees.

21. The method of claim 19 wherein the strip securing surface is convex in contour.

22. The method of claim 19 wherein conveyance surface assumes a concave contour.

23. The method of claim 19 wherein the rotatable transfer element is a puck member.

24. The method of claim 23 wherein the selected degree of angular rotation is about 90 degrees.

25. The method of claim 19 wherein a plurality of rotatable transfer elements each having a strip securing surface with a curved planar contour sequentially process successive strips of material by:

securing a strip of material from the first continuously moving contour-changing conveyance surface, rotating the strip of material secured thereto, and positioning the rotated strip of material in surface contact with a moving surface.

26. The method of claim 25 wherein each of the plurality of rotatable transfer elements sequentially rotate successive strips of material about 90 degrees.

27. The method of claim 19 wherein transmission of a vacuum to the at least one contour-changing conveyance surface results in the at least one contour-changing conveyance surface assuming the contour of an adjacent contour-shaped member.

* * * * *